United States Patent [19]

Chih-Kang

[11] 4,209,992

[45] Jul. 1, 1980

[54] POWER GENERATING METHOD AND APPARATUS

[76] Inventor: Shao Chih-Kang, No. 82, Chien Kuo South Rd., Taipei, Taiwan

[21] Appl. No.: 848,726

[22] Filed: Nov. 4, 1977

[51] Int. Cl.[2] ..... F01K 25/10

[52] U.S. Cl. ..... 60/651; 60/671

[58] Field of Search ..... 60/651, 671

[56] References Cited

U.S. PATENT DOCUMENTS

| | | | |
|---|---|---|---|
| 784,005 | 2/1905 | Ketchum | 60/641 |
| 3,479,817 | 11/1969 | Minto | 60/671 |
| 3,531,933 | 10/1970 | Baldwin | 60/671 X |

*Primary Examiner*—Allen M. Ostrager

*Attorney, Agent, or Firm*—Holman & Stern

[57] ABSTRACT

A power generating plant utilizes a refrigerant as a working medium to drive a turbine, the plant including means to compress and recycle the working medium to a storage vessel from which it is supplied to the turbine. The compressing means includes a reciprocating form of compressor operating with sources of hot and cold liquid derived from within the generating plant itself.

3 Claims, 3 Drawing Figures

POWER GENERATING METHOD AND APPARATUS

BRIEF SUMMARY OF THE INVENTION

This invention relates to a power generating system using a refrigerant (R-liquid) as a working medium. In accordance with the invention, high pressure vaporized refrigerant is used to propel a turbine driving a power generator. Refrigerant exhausted from the turbine is cooled and compressed and is then converted to its liquid phase and recylcles to a storage vessel in which it is heated to the high pressure vapor phase to feed the turbine. Conversion of the refrigerant from its vapor to its compressed liquid phase is effected in a compressing supercharger operating on a source of cold liquid and a source of hot liquid. The source of hot liquid is derived directly from a liquid tank used to heat the high pressure liquid refrigerant and the source of cold liquid is derived from a compressor having a cold liquid circuit in heat transfer flow with a cooling liquid circuit for liquid which is used to cool the refrigerant exhausted from the turbine.

BRIEF DESCRIPTION OF THE SEVERAL VIEWS OF THE DRAWINGS

FIGS. 2 and 3 are combined together for reference.

DESCRIPTION OF THE PREFERRED EMBODIMENT

Figure 1:
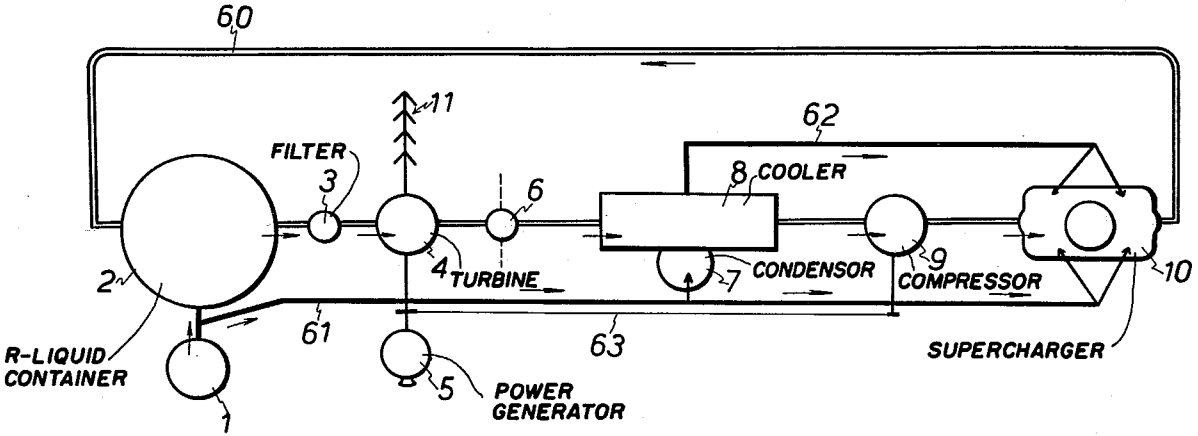
FIG. 1: Flow chart of the power generating procedures by driving the engine with volatile gaseous power.

FIG. 1 is a diagrammatic representation of a power generation system in accordance with the invention and operates as follows:

Highly compressed refrigerant is supplied via a conduit 60 to a container or storage vessel 2 wherein the refrigerant is heated by a heater 1 to convert it into a high pressure, vaporized state. From the container 2, the high pressure vaporized refrigerant passes through a filter 3 and it is then used to drive a turbine 4 operating a power generator 5, reference 11 representing turbine and generator control devices. Exhaust vapor from turbine 4 at an expanded volume approximately four times its original volume, passes through a heat insulating coupling 6 to a cooler 8 then to a compressor 9 and a compressing supercharger 10 which reconverts the gas into its liquid phase and returns the highly compressed liquid via conduits 60 to the container 2. The supercharger 10 is in the form of a recipricatory heat pump arrangement and the sources of hot and cold liquid for the operation thereof are derived respectively from the heater 1 directly through conduit 61 and from a condenser 7 through conduit 62, the condenser also drawing the liquid to be cooled from heater 1 via conduit 61.

Figure 2:
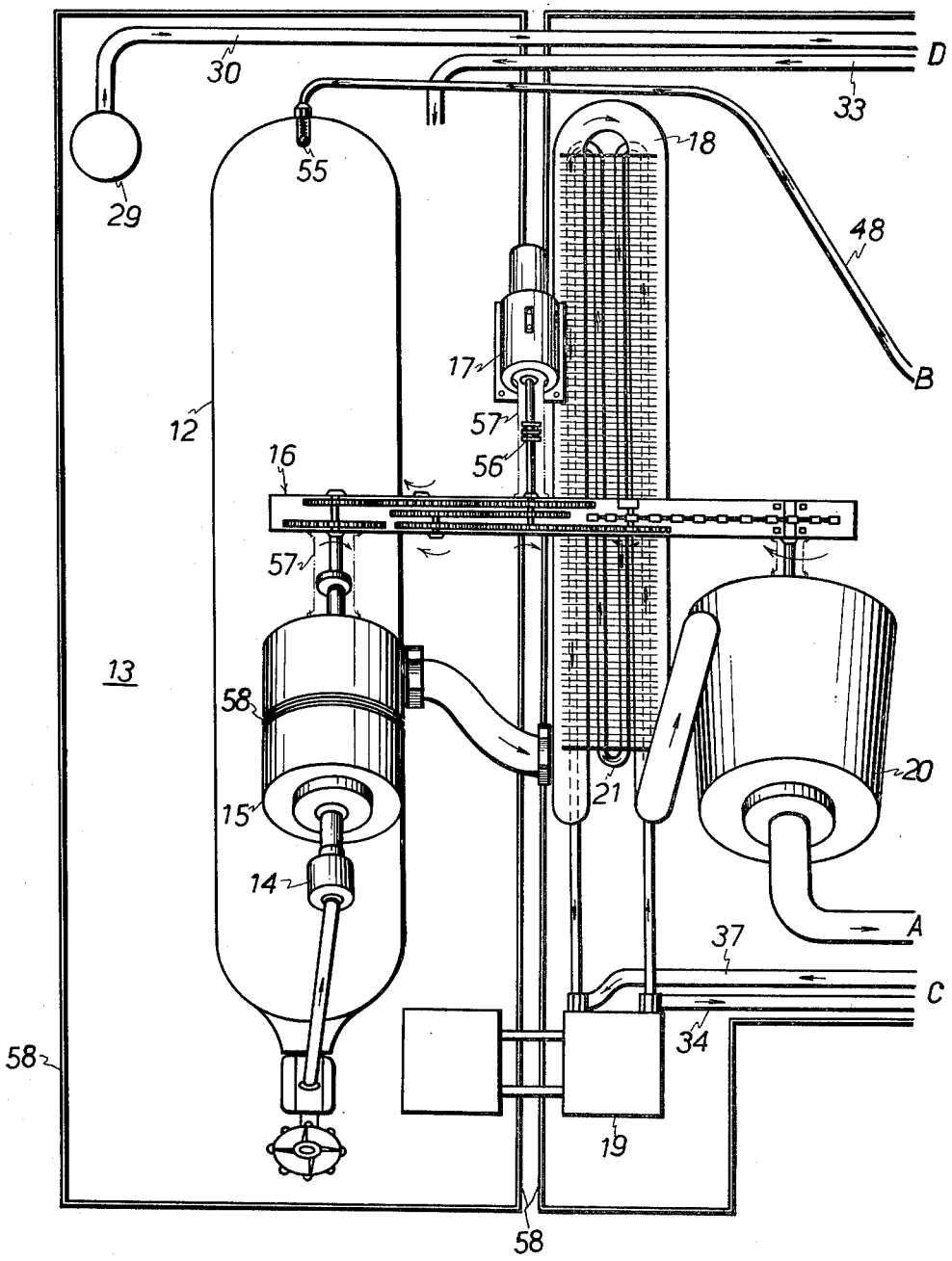
FIG. 2: One of the combinations between the power generating systems and its auxiliary devices and the working fliud cycling chart.
Figure 3:
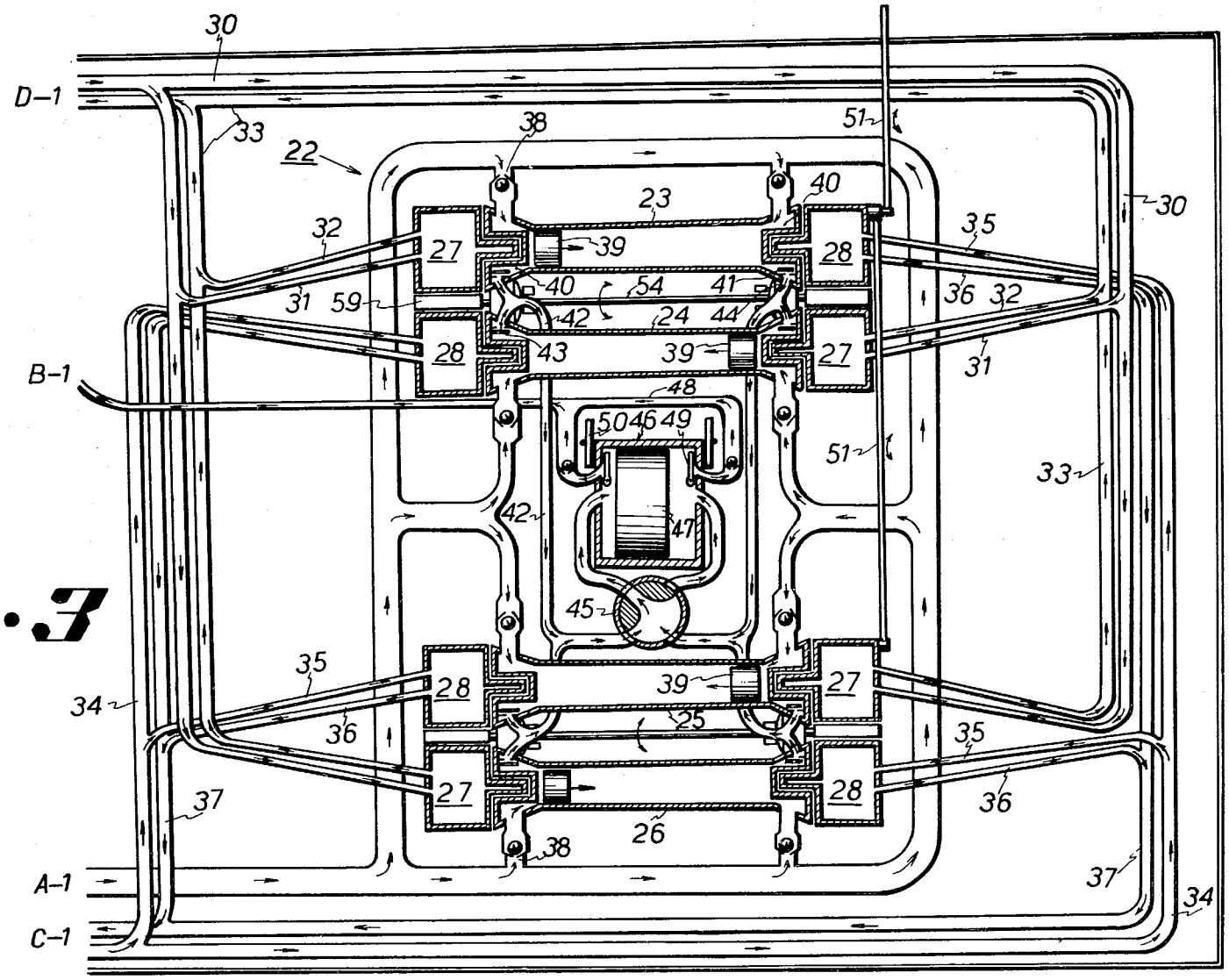
FIG. 3: Same as FIG. 2, chart showing the cycling of the working fluid, A, A-1 and B, B-1 and C, C-1 and D, D-1 are the tubing connections when

FIGS. 2 and 3 show the combination of the power generating system by driving the engine with volatile gaseous power and its auxiliary devices and the working fluid cycling procedures. (Due to limited space of the drawing paper, they are separated into FIGS. 2 and 3. These two charts have to be combined together when taking reference.)

The heating steel cylinder 12 for liquid refrigerant is completely placed into the heating box (13) which contains water, with only the off-on switch portion of the cylinder head extending above the surface of the contained water. Using the thermal sources of solar energy, geothermo or electrical heat for heating the water of the heating box (13), the steel cylinder (12) inside of the heating box will absorb the heat in the water and vaporize the high volatile working fluid (such as R liquid) in the steel cylinder (12), thus changing the original low temperature and low pressure into moderate temperature and high pressure. This high volatile pressure vaporized gaseous power goes through the Gas Filter (14) and then goes into the 2-stage turbo engine (15) thru tubes and drives the blades to run for creating momentum. This momentum is then applied to the transmission (a set of gears) (16) which is connected with the turbo engine (15), to operate the power generator (17). After working in the turbo engine (15), the gas being exhausted is expanded 4 fold as large as its original volume. The exhausted gas goes thru the cooling pressure-decreasing tube (18) and the temperature difference condenser (19) so that by using the cooling tubes (21), the cooling gas would be circulating along the tubing. This cool pressure-decreased exhausted gas then circulate into the compressor (20) for compressing the lower pressure gas. The turbo engine (15) operates counter-clockwise at a rate of 2 to 1 with the compressor (20). Using this ratio of velocity of revolution, the 4-fold volume of the exhausted gas is recovered and compressed into 2-fold expansion volume. The gas at this time is in a state of mist because of the condensation and compression and will be transported to the compressing supercharger (22). This supercharger is a tightly sealed piston-pump which creates pressure difference from low temperature difference, will compress the gas exhausted by the compressor (20), and compressed and condensed into a state of liquid, and then will again compress it and supercharge it to a pressure higher than that of the steel cylinder (12) in order to transport this liquid back to the heating steel cylinder (12). The process of these flows is: compressing supercharger (20) is equipped with 4 cylinders 23, 24, 25 and 26, with each of them has a heat-source container (27) and the cold-source container (28) at both sides. Inside of the heat-source container (27), there are the hot water input and output joints. The piston-pump (29) outputs the hot water from the heating box (13) and the hot water input tubes (30) and the various hot water input manifold will lead it into the heat-source container (27). The output manifold (32) at the other joint will outflow it into hot water output tube (33) and then transport the water back to the heating box (13). There are also the input and output joints inside of the cold-source container. The temperature difference condenser (19) outputs the cooled gas and the cold gas input tube (34) and the cold gas input manifold (35) will lead the cold gas into the cold source container (28) and then the output manifold (36) at the other joint will outflow the cold gas to the cold gas output tube (37) and thus transport the cold gas back into the temperature difference condenser (19). When the gas exhausted by the compressor (20) is compressed and condensed into liquid form, then it goes thru the steel ball valve (38)—used to prevent the high pressure liquid under heating from flow backward- —and enters into the four cylinders 23, 24, 25 and 26 of the compressing supercharger and then its temperature is increased by the heating of the heat-source container (27), therefore, piston (39) will move upward, i.e. the piston (39) of cylinder (23) move toward the right, the piston (39) of cylinder (24) move toward the left, the piston (39) of the cylinder (25) moves toward the left, piston (39) of the cylinder (26) moves toward the right, and at the same time, the liquid at the other end of the piston will be pressed out thru liquid escape holes (43) of the smaller cylinder (40) located at both ends of the cylinders. The liquid escape holes (43) has a magntic valve (41) which is controlled by a permanent magnet (44) for its openning and closing. The manner of its control is: The permanent magnet (44) has an axle (54) which is connected with the center position of the heat-source container (27) and the cold-source container (28). When the movable heat-source container and the cold-source container are exchanging their positions, the permanent magnet will move along with them, at this time, the opening and the closing of the magnetic valve (41) is controlled by the magnetic characteristics of the magnet. When the various pistons (39) are moving but not yet reached the upper dead center, the heating and the cooling action are advanced by two tenth, and at this time, the motion of the connecting rod makes the heat-source and the cold-source container to exchange their positions and make the pistons of the cylinders to move toward the other direction, thus reciprocally pressing out the liquid and the liquid being pressed out from the cylinders will be going thru the liquid escape holes (43), the high pressure tubes and the direction adjustment valve (45), and input into the liquid cylinder (46) for driving the big piston (47). And in the meantime, press out the liquid at the other side to be going thru high pressure tube (48) for returning to the heating box (12). At the bottom end of the heating cylinder (12), there is a steel ball piston (55) to prevent the liquid from flowing backward. Such repeatedly cycling of the heating, condensing and compressing actions on the R liquid may derive momentum for generating power.

At both inner and outer sides of the shell of the liquid cylinder, there is a magnetic valve (49) and the permanet magnet (50) which controls the opening and closing of the magnetic valve (49). At the outer side of the heating box (13), heat-source container (27) and the cold-source container (28) and at the parts where it needs heat insulation, there are the heat-insulation plies (58).

I claim:

1. A method of power generation comprising performing a working cycle on a refrigerant used as a working medium and utilizing said refrigerant to drive a turbine operating a power generator, said cycle including the steps of:

Providing a source of refrigerant in a compressed liquid phase;

Heating said source by immersion in a tank of relatively hot liquid to provide high pressure vaporized refrigerant;

Passing said high pressure vaporized refrigerant through the turbine to drive the turbine, passage of the vaporized refrigerant through the turbine reducing the pressure of the vaporized refrigerant;

Exhausting the reduced pressure vaporized refrigerant from the turbine;

Cooling the reduced pressure vaporized refrigerant;

Compressing the cooled vaporized refrigerant in a compressor arrangement having supplies of hot and cold liquid respectively to convert the refrigerant to its liquid phase at a pressure higher than the source pressure; and Returning the compressed liquid refrigerant to said source, wherein said supply of cold liquid is derived from a condensor circuit through which the cold liquid flows in heat transfer relation with liquid used for cooling the reduced pressure refrigerant and said supply of hot liquid is derived from said tank.

2. A power generation plant utilizing a refrigerant as a working medium comprising a high pressure container providing a source of said refrigerant in a compressed liquid phase, a liquid tank enclosing said container, means for heating liquid in said tank to convert said refrigerant into high pressure vaporized refrigerant, a vapor operated prime mover, means for supplying vapor from said container to said prime mover to operate said prime mover, a power generator driven from said prime mover, cooling means for receiving exhaust vapor from said prime mover and for cooling the exhaust vapor, said cooling means including a cooling liquid circuit in heat transfer flow with said exhaust vapor, compressor means for compressing the cooled exhaust vapor into liquid form, and means for returning the liquid derived from said cool exhaust vapor into said container at a pressure higher than the pressure on the liquid within said container wherein said compressor means includes a reciprocating compressor operated by supplies of hot and cold liquid derived respectively from said tank and from a condensor circuit in heat transfer relation with said cooling liquid circuit.

3. A system of claim 2 wherein said prime mover is a two stage turbine.

* * * * *